United States Patent [19]

Goodnight et al.

[11] 4,281,983

[45] Aug. 4, 1981

[54] PREMIX BURNER SYSTEM FOR LOW BTU GAS FUEL

[75] Inventors: Hershel E. Goodnight; Kurt S. Jaeger, both of Tulsa, Okla.

[73] Assignee: John Zink Company, Tulsa, Okla.

[21] Appl. No.: 16,210

[22] Filed: Apr. 6, 1979

[51] Int. Cl.[3] ..... F23C 5/08; F23C 5/06; F23C 7/00; F23D 17/00

[52] U.S. Cl. ..... 431/161; 431/171; 431/186; 431/187; 431/188; 431/189

[58] Field of Search ..... 431/161, 171, 186, 187, 431/188, 189, 190, 278, 284, 181; 110/182.5

[56] References Cited

U.S. PATENT DOCUMENTS

| | | | |
|---|---|---|---|
| 1,349,971 | 8/1920 | McDonald | 431/171 |
| 1,679,830 | 8/1928 | Lang | 431/186 |
| 1,874,341 | 8/1932 | Osthoff | 431/161 |
| 1,921,152 | 8/1933 | Caldwoll | 431/189 |
| 2,190,768 | 2/1940 | Bryant | 431/161 |
| 2,498,162 | 2/1950 | Heller | 431/189 |
| 2,499,556 | 3/1950 | Zink | 431/189 |
| 2,512,319 | 6/1950 | Ferguson | 431/181 |
| 2,851,092 | 9/1958 | McKee | 431/189 |
| 3,771,944 | 11/1973 | Hovis | 431/174 |
| 3,779,690 | 12/1973 | Rossow | 431/174 |

*Primary Examiner*—George E. Lowrance
*Attorney, Agent, or Firm*—Head and Johnson

[57] ABSTRACT

A premix-type gaseous fuel burning system for alternate or simultaneous combustion of low BTU gas and normal BTU gas comprises a gas supply means for providing both high BTU gas and low BTU gas at selected substantial velocity, and a burner tube for receiving said gas, whereby primary air is inducted into the burner tube and mixed with the gas flow. A burner head comprises a long narrow rectangular structure of tapered construction that is inserted upwardly into a corresponding rectangular opening in the floor of the furnace. The opening is also tapered in the same direction as the burner head, but with a selected annular spacing between the walls of the opening and the burner head. Means are provided for vertically adjusting the position of the burner head within the opening. Secondary combustion air is directed through the annular space between the burner head and the opening in the floor of a furnace.

1 Claim, 4 Drawing Figures

PREMIX BURNER SYSTEM FOR LOW BTU GAS FUEL

BACKGROUND OF THE INVENTION

This invention lies in the field of burners for for burning low BTU gas fuel. More particularly, it concerns a burner system that can accept either or both low BTU gas and high BTU gas, in any selected ratio, to burn effectively in a furnace.

As far as is known, prior art for the burning of low BTU (lean) gases as fuels for conservation of more standard fuels, has made use of unpreximed with air (raw gas) fuel burning principles. Where air can be premixed with fuel before burning the fuel burning is greatly accelerated and improved. The burning of low BTU gas fuel without air premixture leaves much to be desired in the burning process. Raw gas, or unpremixed fuel burning has been the sort of the prior art because it was felt that lean gas would be so diluted by premixture that it would not burn stably or would not burn at all.

We have made a study of a 90 BTU/cu. ft. lean gas which is 28% CO and 72% inert gases, and have invented a burner structure which premixes air with the 28% CO gases to the degree that close to theoretical air is pesent, as the premixed gas-air is discharged for fuel burning in the combustion zone, which is immediately downstream of the gas-air mixture discharge device. Results of the research have proved that air-gas premisture for lean gas combustion is not only feasible but is very advantageous. This special advantage results from stable burning, because of notably increased speed of burning and a more sharply defined combustion zone.

One result of the research is proof that, for a critical service, lean gas can be used as a premix fuel, whereas, when burned in an unpremixed-with-air burner, does not have suitable burnin characteristics for the required service. However, this alone is not enough for the solution of a combustion problem since, because of the low heating value of the lean gases, there may not be enough of them for supply of a required quantity of heat. Because of this, it must be possible to burn both the lean gases and a supplemental fuel supply based on a much richer fuel gas. The supplement gas can be methane (which has 910 BTU per cu. ft. LHV), or natural gas, or equivalent. Both lean and rich gases must be burned in the same burner structure in this case. Such a structure has been proven and is the basis of this invention.

An additional reason for dual fuel operation is that the lean gases are generally products of process operation. Prior to initiation of stable operation there are no lean gases available to burn. In order to establish stable operation from a cold start, a so-called "standard" fuel must be burned for heat production, to make the lean gases available for their fuel value. This requires the use of a common air aspirator and premixer for both fuels. Also, the burning apparatus must be suited to either or both gaseous fuels as required for adequate release of heat, and according to fuel availability.

SUMMARY OF THE INVENTION

It is the primary object of this invention to provide a fuel burning system that is adapted to burn, either separately or together, in any desired ratio, a lean fuel gas which may be of the order of 100 BTU per cu. ft. or less, up to a standard high BTU fuel of the order of 100 BTU per cu. ft. or more.

It is a further object of this invention to provide a burner system for burning either or both of low or high BTU fuels and of changing the relative quantity of each of the fuels during the burning process.

These and other objects are realized and the limitations of the prior art are overcome by providing a burner system which includes a gas supply means to which is supplied a high BTU gas through a central small pipe. The small pipe is surrounded by a larger coaxial pipe, and the annular space therebetween is closed at the upstream end by a wall. Means are provided for introducing the low BTU gas into this annular space, so that both gases will flow longitudinally in the gas supply means and will exit at the downstream end at a selected minimum velocity.

The gas supply means is supported in a position coaxial with the upstream end of a burner tube. The burner tube may be flared for convenience in the induction of primary combustion air, which is induced to flow into the open upstream end of the burner tube due to the velocity of the gases. The primary air induced flows and mixes with the gases as they both travel longitudinally down the burner tube. Means are provided for adjusting the opening for admitting primary combustion air, so that the quantity of air can be controlled.

In one form this type of burner is adapted to be inserted upwardly through an opening in the floor of a furnace and to provide a vertical flame upwardly into the furnace, close to the front wall of the furnace.

To do this burner tube has an angle bend from a horizontal to a vertical direction. It is provided with a burner head, which is a long narrow rectangular horizontal head. This head preferably is made of sheet metal. At the tapered, narrowest, downstream end of the head it is provided with a plurality of openings, or orifices, through which the mixed gas and primary air can flow upwardly to be burned in the furnace enclosure.

The burner head is adapted to fit into a corresponding rectangular opening in the floor of the furnace. This opening is of selected dimension larger in length and width so that there will be an annular space betwen the tapering outside walls of the burner head and a corresponding tapered inner wall of the opening.

The tapering is for the purpose of altering the dimension of this annular space, by raising or lowering the burner head within the tapered opening. This gives control of the velocity of secondary air, and so on, which can be helpful in controlling the stability of the flame.

A secondary air plenum surrounds the downstream portion of the burner tube, so that secondary air led into this plenum thrugh a damper controlled opening, flows upwardly in the annular space between the burner head and the opening in the floor of the furnace.

Means can be provided for enclosing the area of entry of the primary and secondary air, forming a combustion air plenum, to which the total combustion air can be directed, through a conduit from an air preheater or blower as desired.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
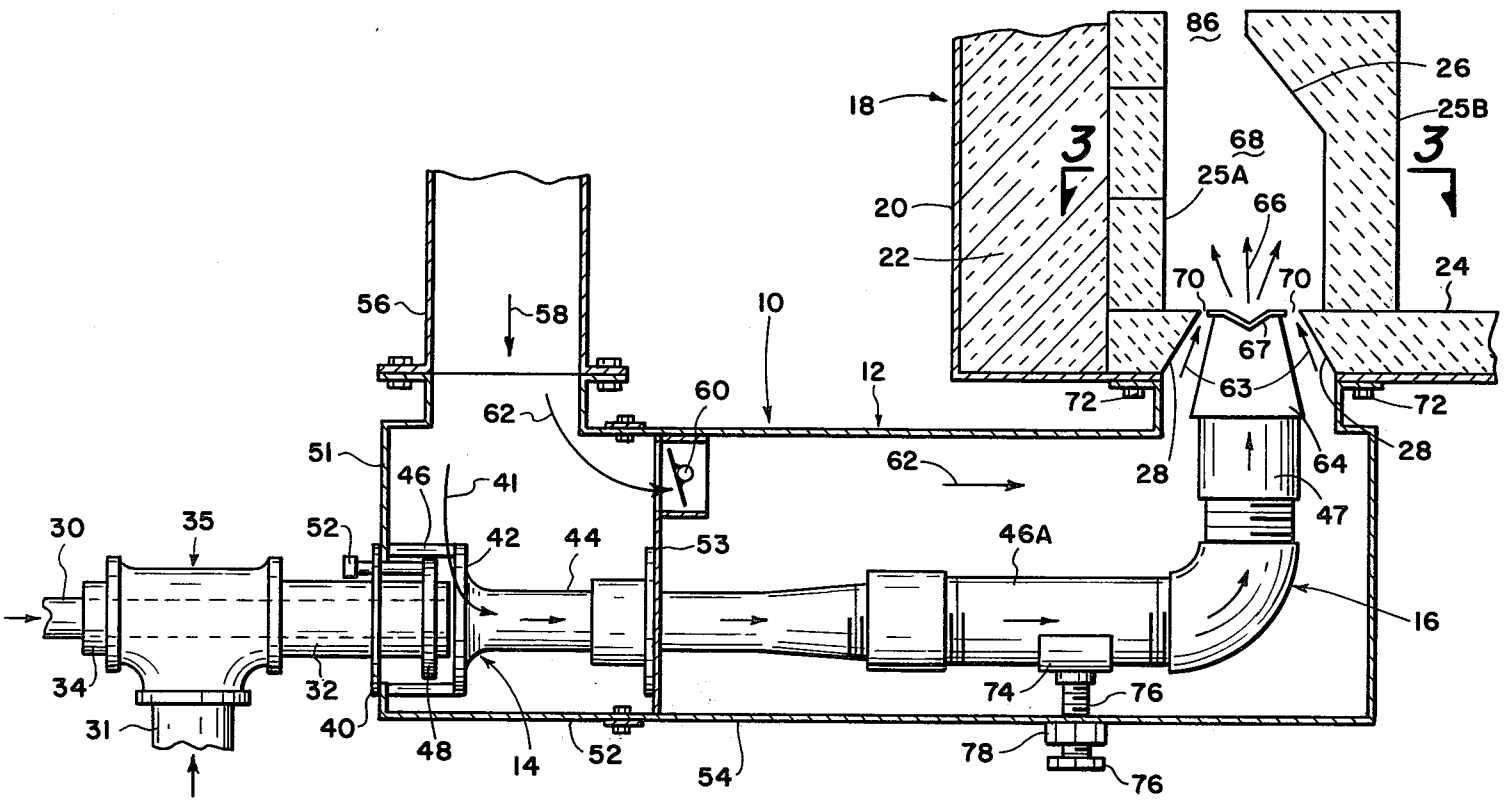
FIG. 1 illustrates in partial cross-section one embodiment of this invention.

Referring now to the Drawings, and, in particular to FIG. 1, there is shown a preferred embodiment of the burner system of this invention. This is indicated generally by the numeral 10. The burner system is broken down into two parts—the secondary air portion indicated generally by the numeral 12 and the primary air portion indicated generally by the numeral 14. This burner is adapted to provide a gas supply for combustion in a furnace indicated generally by the numeral 18. The furnace has a front wall plate of steel 20 and an insulated wall 22. The fuel enters thrugh a burner which is inserted upwardly through the tile 24, which forms the floor of the furnace. There is an opening 28 in this tile through which the burner head 64 is inserted, both the burner head 64 and the opening 28 tapered by selected angles, to provide an annular space 70 between the burner head 64 and the opening 28 for flow of secondary air.

Figures 2, 4:
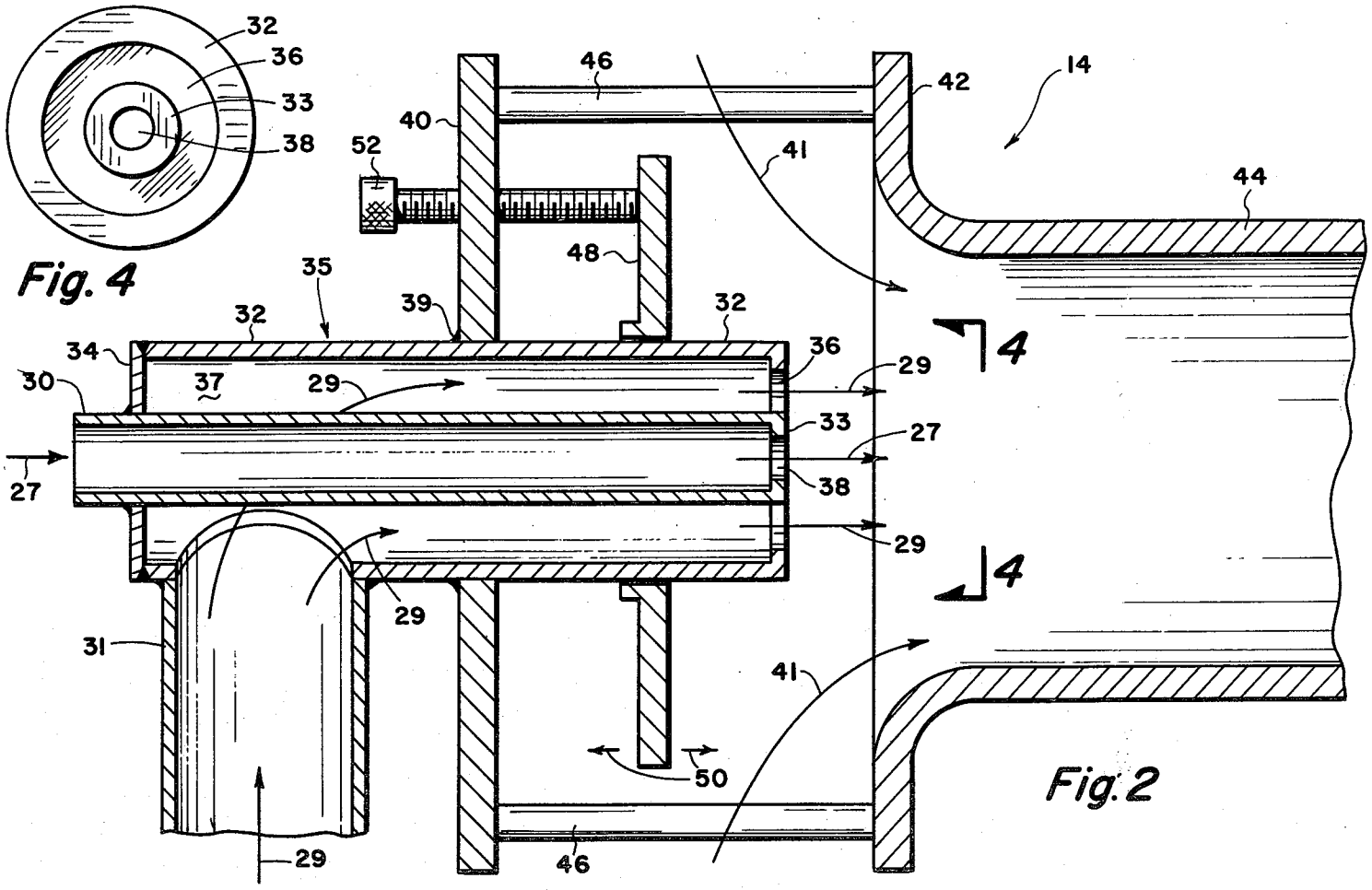
FIG. 2 shows in cross-section, in greater detail, the area of gas flow into the burner tube.
FIG. 4 illustrates the orifice in the gas supply means through which high BTU and low BTU gases can flow.

This burner 10 is adapted to burn either a low BTU gas or a high BTU gas, or both together, in any desired ratio. The burner includes a gas supply means indicated generally by the numeral 35. This can be fabricated of pipe fitting as in FIG. 1, or more generally as shown in FIG. 2, to which reference is now made.

There is a central small tube 30 through which high BTU gaseous fuel can flow in accordance with arrow 27. Surrounding this inner small tube 30 is a larger diameter tube 32, which is coaxial with the inner tube, providing an annular space 37 between the two tubes. A side tube 31 is provided, leading into the space 37, through which low BTU gas flows in accordance wit arrows 29. It is preferable that both of these gases be supplied under a selected pressure so that at they flow through the tubes and out through appropriate openings 38 in the central tube 30, and annular opening 36, surrounding the inner tube 30, there will be corresponding flows of rich gas 27 through the central opening 38 and lean gas through the annular opening 36 in accordance wit arrows 29.

With a selected minimum velocity of flow of the rich and lean gases issuing from the downstream end of the gas supply means 35, and with the gas flow progressing axially into the burner tube 44, there will be induction of primary air in accordance with the arrows 41.

The gas supply means 35 is supported by means, such as welds 39, to a plate 40, which is supported by legs 46 to the bell portion 42 of the burner tube 44. A sliding damper or plate means 48 can be traversed in accordance with arrows 50 to control the flow of primary air. The screw 52 is provided for adjustment of the annular opening through which the primary air 41 can flow.

Referring again to FIG. 1, the burner tube 44 is supported from the vertical wall 53 of a secondary air plenum 12, which is supported from the bottom of the furnace by means of bolts 72, for example. There is an air opening in the wall 53 for the flow of secondary air indicated by the arrow 62. An adjustable damper means 60, well-known in the art, controls the secondary air flow 62.

Figure 3:
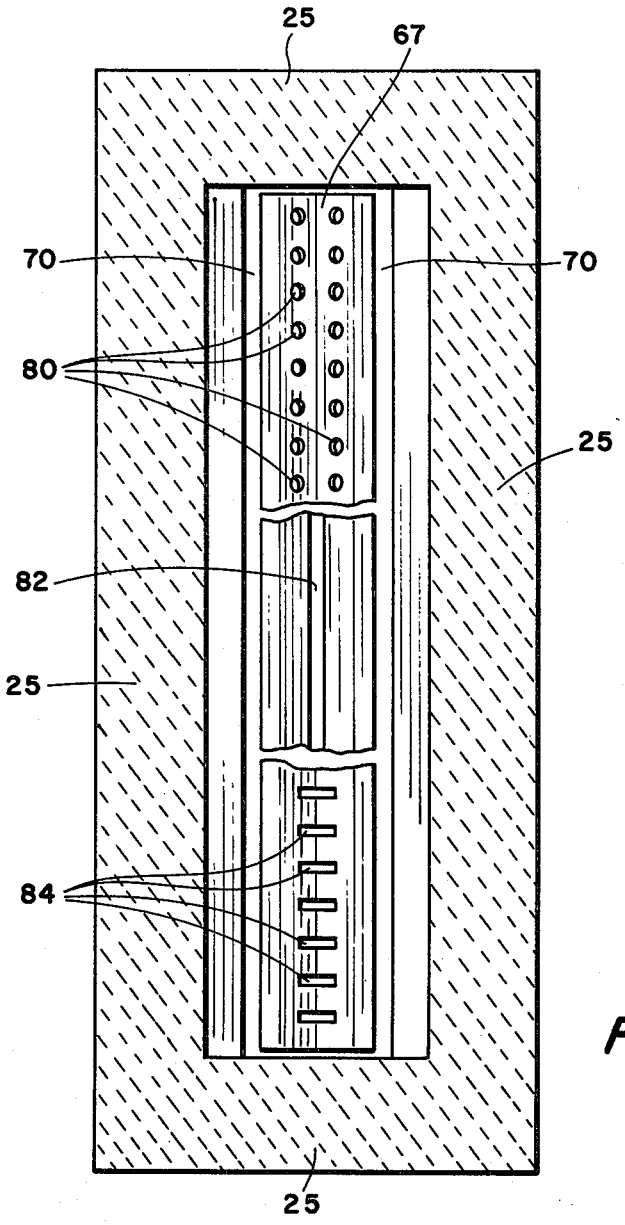
FIG. 3 shows a view taken along the plane 3—3 of FIG. 1, illustrating the various ways in which openings can be provided for the flow of the mixture of gas and primary air fro the burner head up into the furnace.

The burner tube 44 expands into a somewhat larger diameter pipe 46, and bends upwardly in the form of pipe 47, which is provided with a burner head 64. This burner head is a tapering recatangular sheet metal plenum, that has a plurality of orifices on the downstream end 67. This is shown in FIG. 3, which is a cross-section taken across the plane 3—3 of FIG. 1. This view shows the annular space 70 on each side of the burner head. It also shows three different types of orifice arrangements. One type comrises the rows of circular orifices 80 in the closure end 67 of the burner head. Another type is a group of short traverse orifices 84. A third type is indicated by the central portion which shows a long narrow aperture 82.

The base or floor 24 of the furnace is made of ceramic tile, and there is a ceramic tile enclosure comprising the walls 25A and 25B surrounding the burner head 64.

A preferred embodiment of the ceramic wall is illustrated in FIG. 1 and involves a sloping inner portion 26 of the wall 25B that overhangs by half the top of the burner head. This provides a relatively small enclosure 68 in which combustion takes place. The sloping wall 26 causes the flame to be projected out through the open top 86 in a direction toward the front wall of the furnace, to provide a radiant surface for better heat transfer to the fluid-carrying pipes.

The secondary air, in accordance with arrow 62, flows thrugh the damper 60 and along the plenum 54 and up through the annular space 70, in accordance with arrows 63. The gas and primary air issue from the orifices 80, 82 or 84, in accordance with arrows 66.

Means have been provided for vertical adjustment of the burner head 64 inside of the opening 28 in the floor tile 24. This comprises a saddle 74 supported by te plenum 54, which can be raised and lowered by means of a screw 76, adjusted in the nut 78 which is welded to the bottom plate of the secondary air plenum 54.

We have discovered that relatively close control of the ratio of primary air volume to secondary air volume, to create a total combustion air volume, is significant for two reasons. One reason is to provide stable burning of fuel. The second reason is avoidance of too great a total air supply, which would thus cause a loss of heat from the fuel burning. However, there must be some excess air in order to completely burn the fuel, since loss of unburned fuel would provide a greater loss than that due to excess air.

This burner is adapted to receive fuel-saving preheated air. The air may be preheated by means of heat recovery from combustion gases, after all normal heat recovery has been taken care of, other than for air preheat, as is well known in the art. Mechanical means, such as fans or blowers (not shown), can deliver the preheated air to the burner by means of the duct 56. This can be attached in a well-known manner to the enclosure 51, which surrounds the primary air inlet indicated generally by numeral 14. The preheated air would flow in accordance with arrow 58 down the conduit 56. Part would go through the primary air inlet 42 in accordance with arrow 41. Part would go in accordance with arrow 62 through the damper 60 into the secondary air plenum 54.

This burner can be used with natural draft, since the pressure in the furnace in the region of the flame would be below atmospheric pressure and, therefore, would cause flow of primary and secondary air in accordance with arrows 41 and 62. In that case the plenum 51 could be in use. Pressure downstream of the burner tile inside the furnace normally would be less than atmospheric pressure. If forced draft is to be used, as with preheated air, the plenum 51 would then be used.

The relative vertical relationship of the burner head 64 and opening 28 has been discovered to be critical to stable fuel burning in most cases. To permit control of this relationship, the position of the burner head can be adjusted vertically by means of the screw 76 operating against the saddle 74 holding the pipe portion 46 of the burner tube.

The reason for this adjustability is that the air pressure drop due to the flow 63 within the annular space 70 affects the flow of secondary air as it meets the gas-air mixture flowing from orifices in the top plate 67 and burning within the space 68 and above. The relative position affects the conditions of stability for fuel burning, determines the speed of fuel burning, and establishes the flame conditions in the space 68.

While it is desirable to have the overhang 16 of the tile 25 above the burner head, the burner system can be operated with a straight vertical wall of the tile 25B. In general, the wall 25A is preferred to be adjacent the front wall 22 of the furnace and the overhang 26, if present, leans toward the front wall of the furnace.

It is clear that the area of all of the orifices in the end 67 of the burner head must be such as to provide minimum pressure drop to the total flow of gases 27, 29 and primary air 41.

FIG. 4 illustrates a view taken along plane 4—4 of FIG. 2 and shows the central orifice 38 which passes a high BTU gas when present, and the annular orifice 36 that passes the flow of low BTU gas when present.

This invention provides a burner system which is adapted to take normal atmospheric air and also to take preheated air supplied under pressure by blower or fan, and is duct delivered. The tile and shroudment of the burning fuel in the space 68 serves to increase the stability of the burning.

While this invention has been described with a certain degree of particularity, it is manifest that many changes may be made in the details of construction and in the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

It is claimed:

1. A premix burner system for alternate or simultaneous combustion of low BTU (100 BTU per cubic foot or less) higher BTU gaseous fuels in a furnace comprising;

(a) an inner tube, and means to supply higher BTU gas under pressure to the upstream end of said inner tube;

(b) a larger concentric outer tube surrounding said inner tube, forming an annular space therebetween, said annular space closed at the upstream end; and means to supply said low BTU gas under pressure to said annular space;

(c) a downstream outlet for said inner and outer tubes terminating opposite and spaced from a burner tube whereby primary air is inducted and mixed with said gases for flow in said burner tube, means to control the flow of said primary air into said burner tube;

(d) a burner head comprising a long narrow rectangular structure transversely connected to said burner tube, said head tapered inwardly in the downstream direction;

(e) a furnace having a floor with a rectangular opening therein selectively larger than the dimensions of said burner heads; said opening tapering in the same direction as said burner head;

(f) means to support said burner below said furnace floor with said burner head inserted into said opening;

(g) a secondary air plenum surrounding said burner tube and leading to the annular space between said burner head and said opening in said furnace floor; and including means to control the flow of air into said secondary air plenum;

(h) an enclosure means surrounding the primary and secondary air inlet portion of said burner system, forming a combustion air plenum; and (i) means for vertical adjustment of said burner head in said opening.

* * * * *